United States Patent [19]

Isobe et al.

[11] 4,377,348

[45] Mar. 22, 1983

[54] PRINTER HEAD FOR SERIAL DOT PRINTER

[75] Inventors: Minoru Isobe; Hiroshi Kikuchi; Minoru Teshima, all of Tokyo; Tadasi Kodama, Sakura, all of Japan

[73] Assignee: Oki Electric Industry Co., Ltd., Tokyo, Japan

[21] Appl. No.: 244,077

[22] Filed: Mar. 16, 1981

[30] Foreign Application Priority Data

Mar. 27, 1980 [JP] Japan ..... 55-38176

[51] Int. Cl.[3] ..... B41J 3/12

[52] U.S. Cl. ..... 400/124; 101/93.05; 335/217

[58] Field of Search ..... 400/124, 691, 693; 101/93.05; 335/217; 75/123 R, 170

[56] References Cited

U.S. PATENT DOCUMENTS

| | | | |
|---|---|---|---|
| 2,975,339 | 3/1961 | Mitchel et al. | 335/217 |
| 3,325,757 | 6/1967 | Gang | 335/217 |
| 3,556,150 | 1/1971 | King | 335/217 X |
| 3,659,238 | 4/1972 | Griffing | 335/229 |
| 3,831,051 | 8/1974 | Ohgoshi et al. | 335/217 X |
| 4,009,772 | 3/1977 | Glaser et al. | 400/124 |
| 4,044,668 | 8/1977 | Barrus et al. | 101/93.04 |
| 4,225,250 | 9/1980 | Wagner et al. | 400/124 |

*Primary Examiner*—Paul T. Sewell

*Attorney, Agent, or Firm*—Armstrong, Nikaido, Marmelstein & Kubovcik

[57] ABSTRACT

A serial printer head is provided which comprises a sandwich structure (1,3,5) of a first circular yoke plate (1), a cylindrical magnet (3) and a ring shaped second yoke plate (5); a plurality of electromagnets (2,4) positioned on the first yoke plate (1) at predetermined angle intervals; an armature-print-needle assembly (7,8,9,10) having a circular resilient spring (7), a plurality of armatures (8) and a plurality of print needles (9) placed on the sandwich structure (1,3,5) so that the sandwich structure (1,3,5), electromagnets (2,4) and the armatures (8) provide first a substantially closed magnetic path; and an adjusting yoke (12) attached to the sandwich structure (1,3,5). The adjusting yoke (12) has the magnetic characteristics that the magnetic reluctance increases as the temperature increases. Although the flux generated by the permanent magnet (3) is changed due to the change of the temperature, that flux change is compensated for by the presence of the adjusting yoke (12).

6 Claims, 15 Drawing Figures

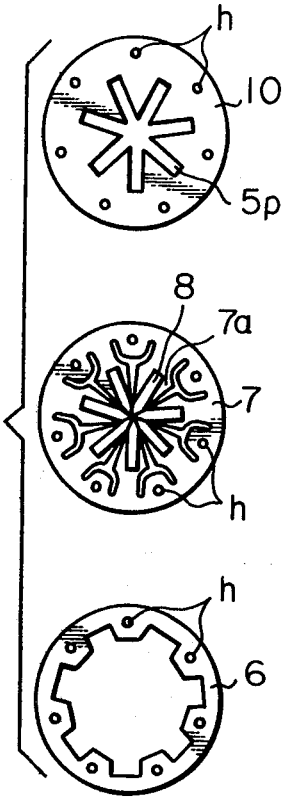
FIG. 3C(I)
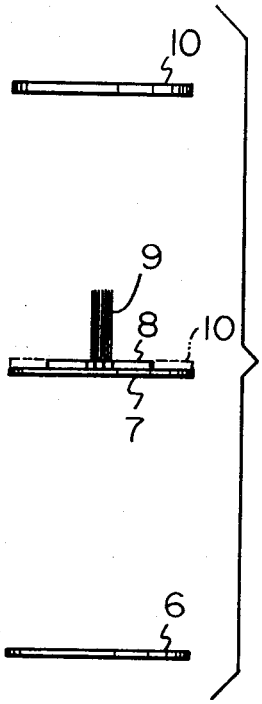
FIG. 3C(II)
Fig. 3D
Fig. 3E
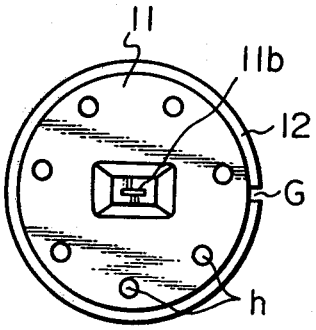
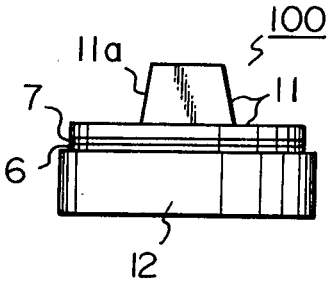

PRINTER HEAD FOR SERIAL DOT PRINTER

BACKGROUND OF THE INVENTION

The present invention relates to the improved structure of a printer head for a dot printer, in particular, relates to the structure of a serial printer which can operate with improved high speed in a high temperature condition.

FIG. 1 shows the principle of the dot matrix printing in a serial printer. A printer head 100 has seven needles for mosaic printing, and travels along a printing line in the direction of the arrow A. During the travelling, needles are selectively drived to hit a paper through an ink ribbon and a desired pattern "A", "B", "C" or "D" is printed. The selection of needles is controlled by the content of an integrated circuit (IC) memory. When the size of a character to be printed is 2.67 mm×2.05 mm, 7×5 number of dots are enough for printing a recognizable character.

One of the prior needle dot heads for a dot printing process is shown in the U.S. Pat. No. 3,896,918, in which an electro magnetic drive for the operation of printing needles of a mosaic printing head includes a pivotally mounted armature for each needle which are arranged along a circular arc. The construction includes a common yoke for all of the electro magnets which comprise of two concentric cups or walls forming a single unit with cylindrical cores arranged at equal intervals along a circular arc parallel to the genatrix of the cup and located between the individual yoke cups. However, said prior printing head has the disadvantages that the power consumption for driving the needles is large, the size of the apparatus is large, and the operational speed of the printer is rather slow. Those disadvantages come mainly from the fact that a needle is driven by an electromagnet, and all the printing power for striking a piece of paper by a needle is given by said electromagnet.

Another print head for a serial dot matrix printer is shown in U.S. Pat. No. 4,225,250, in which a needle is biased to the first position by a permanent magnet, and balanced at that first position with the force of a spring. When an electromagnet is energized, the flux of the permanent magnet is cancelled, and the needle is moved to the second position by the force of the spring. In this prior art, the printing power for striking a paper by a needle is produced by a spring, not by an electromagnet. Therefore, this printer can be small in size, lower in power consumption, and operate with a relatively high printing speed. However, this printer head has the disadvantage that the printing speed is still not quick enough.

Further, a prior printer head has another disadvantage that printing speed and printing quality in a high temperature condition are not sufficient enough. Those disadvantages come from the decrease of the magnetic flux of a permanent magnet in a high temperature condition. FIG. 2 shows the strength of the magnetic flux of a typical ferrite permanent magnet, in which the vertical axis shows the strength of the flux (energy product) and the horizontal axis shows the temperature. As apparent from FIG. 2, the magnetic flux of a ferrite permanent magnet is considerably reduced in a high temperature condition, and then, the force for attracting a plate spring and/or an armature becomes insufficient in a high temperature condition. The lack of force of a permanent magnet of a printer head provides the undesirable decrease of the printing quality and/or the decrease of the printing speed.

The particular material, like Alnico material, which provides excellent characteristics even in a high temperature condition, is available on the market. However, that material is expensive when compared with ferrite material, and the use of that material would increase the price of a printer head itself.

Other prior printer heads are shown in U.S. Pat. No. 3,659,238 and No. 4,044,668. However, the characteristics of those printer heads are still not sufficient for operation enough in a high temperature condition.

Since the continuous operation of a printer head rises the temperature of the printer head itself, the stable operation at the high temperature is material for a printer head.

SUMMARY OF THE INVENTION

It is an object, therefore, of the present invention to overcome the disadvantages and limitations of a prior serial printer head for dot matrix printing by providing a new and improved printer head.

It is also an object of the present invention which operates at a high temperature condition to allow a continuous high speed printing.

The above and other objects are attained by a printer head comprising of a first circular yoke plate; a cylindrical permanent magnet magnetized in an axial direction positioned on said first yoke plate; the premanent magnet having the characteristics that the flux generated by the permanent magnet decreases as the temperature increases; a ring shaped second yoke plate positioned on said permanent magnet; a plurality of electromagnets each having a column core and a coil wound on the column core; the electromagnets being positioned in a circle on said first yoke plate with predetermined angle intervals; an armature-print-needle half assembly having at least a disk shaped circular resilient spring having a plurality of inwardly extended projections, a plurality of armatures each fixed on the related projection of said spring, and a plurality of print needles each fixed to the related armature so that the print needle extends perpendicular to the spring plane; a guide frame covering said armature-print-needle half assembly with a thin linear slit for passing through the tops of said print needles; a first substantially closed magnetic path being provided from said permanent magnet through said second yoke, said armature, said electromagnets and said first yoke plate to said permanent magnet so that an armature together with the related print needle are attracted to the related electromagnet by the magnetic flux circulating in said first magnetic path, said armature, and the related print needle is released by the force of the spring upon application of electric current to the coil of the related electromagnet to print a dot; a cylindrical adjusting yoke being attached to said first yoke plate, said permanent magnet and said second yoke plate to provide a second closed magnetic path from said permanent magnet through the second yoke plate, the adjusting yoke and the first yoke plate to the permanent magnet; and said adjusting yoke having the magnetic characteristics that the magnetic reluctance of said adjusting yoke increases as the temperature of said adjusting yoke increases.

BRIEF DESCRIPTION OF THE DRAWINGS

The foregoing and other objects, features, and attendant advantages of the present invention will be appreciated as the same become better understood by means of the following description and accompanying drawings wherein;

FIG. 3D is a top view of the present printer head, FIG. 3E is an elevation view of the present printer head.

DESCRIPTION OF THE PREFERRED EMBODIMENTS

Figure 1:
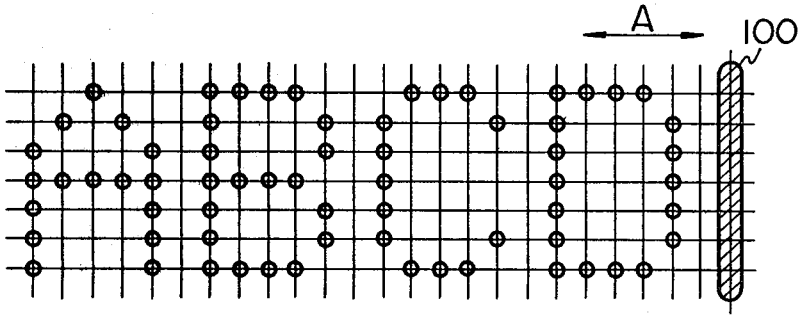
FIG. 1 shows a mosaic pattern for the explanation of the dot matrix printing of the present invention.
Figure 2:
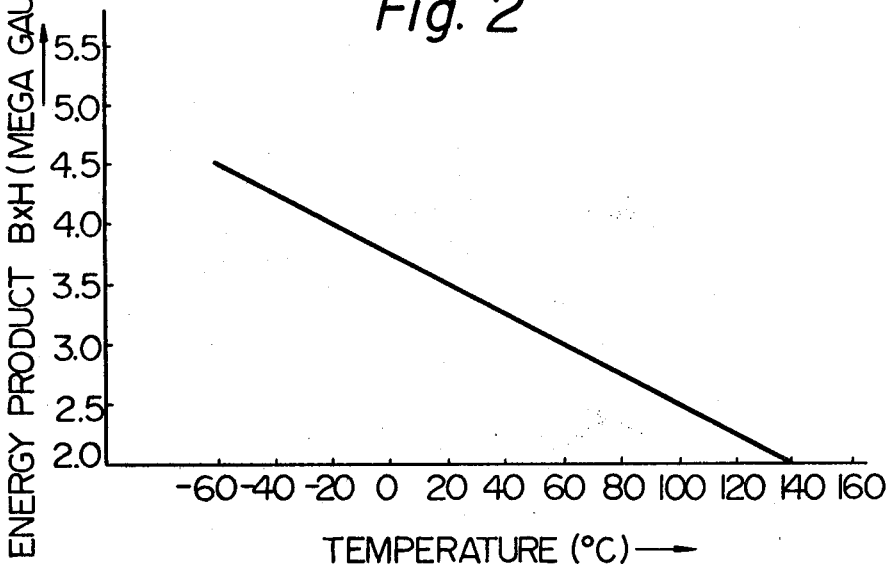
FIG. 2 shows a curve of the characteristics of a typical ferrite permanent magnet for the change of the temperature.
Figure 3A:
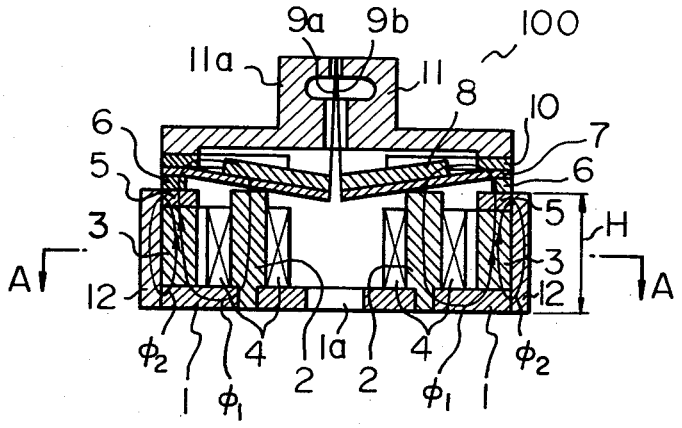
FIG. 3A is a cross sectional view of the printer head according to the present invention.
Figure 3B:
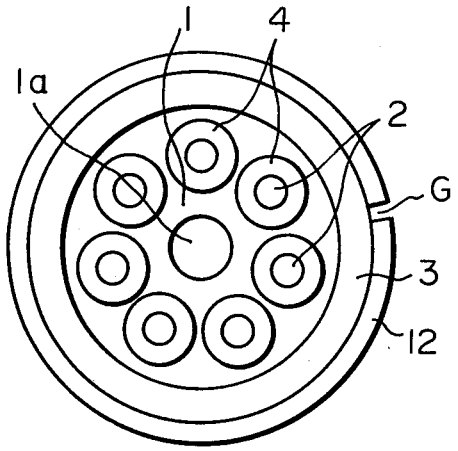
FIG. 3B is the cross sectional view at the line A—A of FIG. 3A, FIG. 3C(I) and FIG. 3C(II) show the disassembled views of an armature-print needle half assembly.

FIGS. 3A through 3E show the structure of the embodiment of the printer head according to the present invention, in which FIG. 3A is the elevational cross sectional view, FIG. 3B is the cross section at the line A—A of FIG. 3A, FIG. 3C shows the disassembled view of the armature-print needle half assembly, FIG. 3D is the top view of the printer head, and FIG. 3E is the side view of the printer head. In those figures, the reference numeral 1 is the first circular yoke plate made of ferro-magnetic material, having a center hole 1*a*, 2 is a column core made of preferably silicon steel which operates as a magnetic core of an electromagnet, and said column core 2 is distributed with the predetermined angle interval on a circle on the first yoke plate 1 (see FIG. 3B). Each of the column cores 2 is fixed on the yoke plate 1 by engaging the thin end of the same with the yoke plate 1 as shown in FIG. 3A. The reference numeral 4 is a coil wound on said column core 2. The lead wires of said coil 4 extends to an external circuit through the hole 1*a* of the yoke plate 1. The reference numeral 3 is a cylindrical magnet magnetized in the axial direction, and is made of ferrite material, fixed on the yoke plate 1. The reference numeral 5 is the ring shaped second yoke plate, and it should be noted from FIG. 3A that the top level of the second yoke 5 coincides with that of the column core 2 of the electromagnet. Those members (first yoke plate 1, column cores 2, coils 4, permanent magnet 3 and second yoke plate 5) compose a magnet half assembly.

The reference numeral 6 is a thin ring shaped spacer made of ferro-magnetic material for providing a gap between the armatures and column cores (see FIG. 3C). The reference numeral 7 is a circular disk shaped spring made of preferably carbon steel, having a common outer ring and a plurality of projections projected from the common ring towards the center of the disk, and it should be noted that each projection can be individually biased or curved from the common outer ring. The reference numeral 8 is an armature fixed on each projection of the spring disk 7. The reference numeral 9 (9*a*,9*b*) is a print needle extending perpendicular to the plane of the spring 7, and being fixed at the extreme end of the armature 8 through welding. The reference numeral 10 is a circular third yoke plate having the radial slits for accepting the armatures as shown in FIG. 3C. Those members (a spacer 6, a spring 7, armatures 8, print needles 9, and the third yoke plate 10) compose an armature-needle half assembly as shown in FIG. 3C. Those members have a plurality of small holes (h) with which that half assembly is fixed by screws to the magnet half assembly.

The reference numeral 11 is a guide frame made of non-magnetic material. On the center of the guide frame 11, the post 11 with the linear slit 11*b* is provided. Said slit 11*b* accepts the top of the print needles 9. The guide frame 11 has also a plurality of holes (h), with which the guide frame 11 is fixed by screws to the magnet half assembly.

The reference numeral 12 is a ring shaped adjusting yoke which has the magnetic characteristic that the magnetic reluctance of the same increases as the temperature increases. In the embodiment of FIGS. 3A through 3E, the adjusting yoke 12 covers the first yoke plate 1, the permanent magnet 3 and the second yoke plate 5, that is to say, the height or the width (H) of the adjusting yoke is almost the same as the sum of the thickness of the first yoke plate 1, the width or the height of the permanent magnet 3 and the thickness of the second yoke plate 5. Preferably, the adjusting yoke is C-ring shaped, having a small gap (G) (see FIG. 3B). Thus, the adjusting ring 12 is fixed outside the magnet half assembly by the spring action of the adjusting ring itself.

The adjusting yoke 12 is made of adjusting steel or adjusting alloy having the components Fe-Ni-Cr. That adjusting alloy is supplied for instance by Sumitomo Tokushu Kinzoku Co., Ltd, in Tokyo, Japan in the trade name MS-1, MS-2 and MS-3. In case of MS-2, the temperature coefficient of the flux density in the adjusting yoke is $-0.8\%/°C$.

In the above structure, the first substantially closed magnetic path is provided from the permanent magnet 3 through the second yoke plate 5, the spacer 6, the third yoke plate 10, each of the armatures 8, each of the column cores 2, the first yoke plate 1, to the permanent magnet 3. Also, the second closed by-path magnetic path is provided from the permanent magnet 3 through the second yoke plate 5, the adjusting yoke 12 and the first yoke plate 1, to the permanent magnet 3.

It should be noted that the number of the print needles 9 is equal to the number of the armatures 8, the projections of the plate spring 7, and the column cores 2, and each combination of each print needle, each armature, and each column core operates to print each dot. The extreme top head of the print needles 9 is aligned on a straight line in the slit 11*b* for a mosaic printing.

Now, the operation of the present printer head is described.

It is assumed first that the temperature is the normal room temperature (25° C. for instance).

When the coils 4 are not energized, the magnetic flux induced by the permanent magnet 3 circulates from the magnet 3, through the second yoke 5, the spacer 6, the third yoke 10, the armatures 8, the column cores 2, and the first yoke 1 to the magnet 3. Also, some portion of the magnetic flux of the permanent magnet 3 circulates in the second magnetic path from the permanent magnet 3 through the second yoke 5, the adjusting yoke 12 and the first yoke 1 to the permanent magnet 3. Because of the magnetic flux in the first closed magnetic path, the armatures 8 together with the projections of the spring 7 are attracted to the respective column cores 2 by the force of the permanent magnet 3. Each of the armatures 8 and the projections of the spring 7 are attracted by the related column core 2 independently, and when the armatures are attracted by the cores, the tops of the print needles are withdrawn or secured in the guide frame 11. Also, it should be noted that the projections of the spring 7 is curved or biased to store the energy by being attracted to the column cores 2.

Next, when one of the coils 4 is energized by flowing the electric current in said coil 4, the related column core 2 is magnetized, so that the magnetic flux generated by the coil 4 cancels the magnetic flux in the column core in the first magnetic path by said permanent magnet 3. Therefore, the related armature 8 is not attracted by the column core 2 anymore, but is released. When the related projection of the plate spring 7 is released, the print needle 9 attached at the armature 8 is strongly forced to go out of the guide frame 11, and the needle thus pushed strikes a paper through an ink ribbon (not shown), then, a dot is printed on a piece of paper. Therefore, a needle is driven by the energy stored in the spring, and the printing force applied to a needle is always constant if the flux generated by the permanent magnet is constant.

Next, when the electric current in the coil 4 stops, the magnetic flux generated by the coil 4 is also stopped and the magnetic flux generated by the permanent magnet 3 is no longer cancelled in the related column core 2, then, the armature 8 and the related needle 9 are attracted again to the related column core 2.

In the above explanation, it is assumed that the permanent magnet 3 of a ferrite material provides the flux $\phi$. Some portion $\phi_1$ of that total flux $\phi$ circulates in the first magnetic path from the permanent magnet 3 through the second yoke 5, the spacer 6, the third yoke 10, the armature 8, the column core 2 and the first yoke 1 to the permanent magnet 3, and the other portion $\phi_2$ circulates in the second magnetic path from the permanent magnet 3 through the second yoke 5, the adjusting yoke 12, and the first yoke 1 to the permanent magnet 3. And the following formula is satisfied.

$$\phi=\phi_1+\phi_2$$

When the temperature of the printer head and/or the permanent magnet 3 is low, the permanent magnet 3 provides a large amount of magnetic flux and the value of the total flux $\phi$ is large.

Next, when the temperature of the printer head and/or the permanent magnet 3 is high, the magnetic flux by the permanent magnet 3 is decreased because of the characteristics of the ferrite material. That high temperature condition comes from, for instance, the energy loss in the printer head itself, and the higher the operational speed of the printer is, the higher the temperature becomes. It should be noted in this case that when the temperature of the permanent magnet 3 is high, the temperature of the adjusting yoke 12 is also high, and the temperature of the latter is almost the same as that of the former since the adjusting yoke is directly attached to the permanent magnet 3 with a large contact area.

Therefore, when the temperature of the permanent magnet 3 is high and the total flux $\phi$ is decreased, the magnetic reluctance in the adjusting yoke is increased and then the magnetic flux $\phi_2$ in the adjusting yoke is also decreased. That is to say, the decrease of the total flux $\phi$ is compensated by the decrease of the flux $\phi_2$, and then, the flux $\phi_1$ in the first magnetic path can be constant irrespective of the change of the total flux $\phi$ and/or the temperature. Accordingly, the force for attracting armatures to column cores is constant irrespective of the change of the temperature and/or the change of the total flux $\phi$, and the present printer head can operate even in a high temperature condition.

Figure 4:
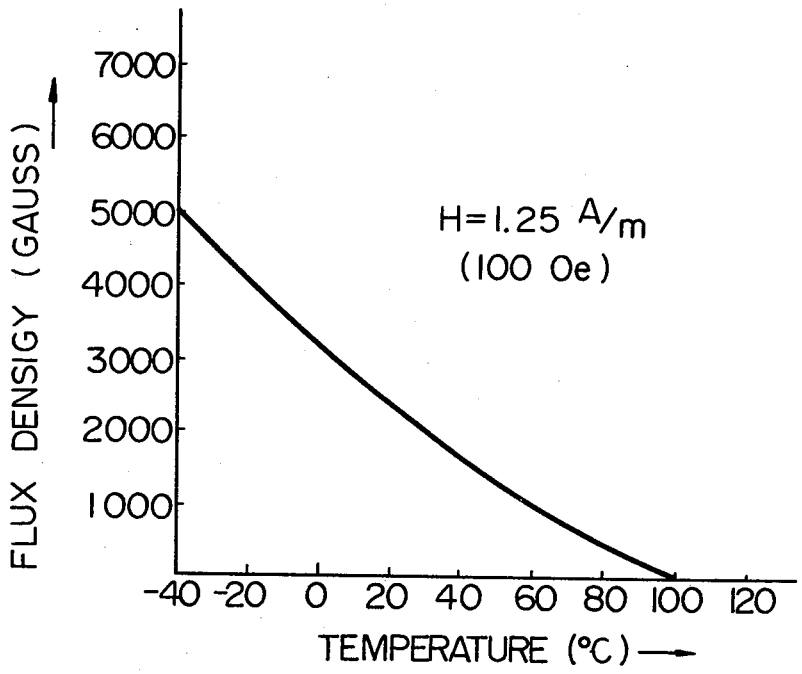
FIG. 4 is a curve showing the magnetic characteristics of an adjusting material.

FIG. 4 shows the example of the curve between the flux density and the temperature of Ni-Fe-Cr adjusting material when the magnetic field is 100 Oersted. The material of FIG. 4 is conveniently utilized as an adjusting yoke of the present printer head. It should be noted in FIG. 4 that the flux density decreases as the temperature increases. That characteristics come from the magnetic characteristics that the reluctance increases as the temperature increases.

Figure 5:
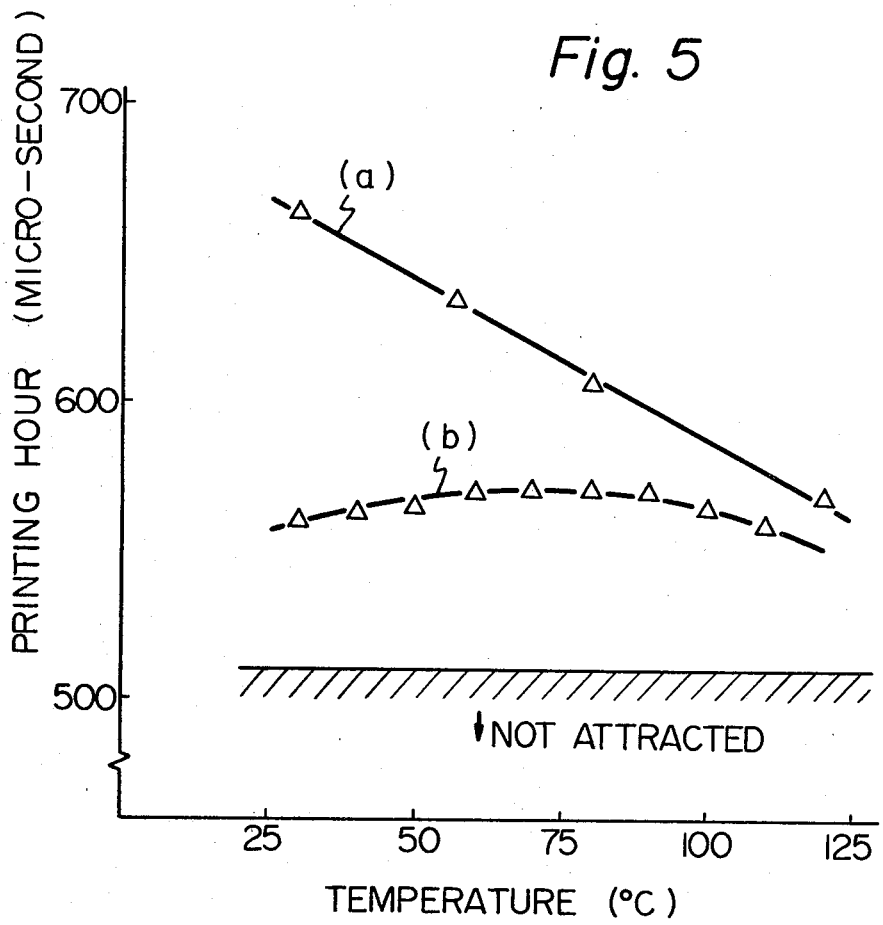
FIG. 5 shows the printing characteristics of the present printer head when the temperature is changed.

FIG. 5 shows the curve showing the effect of the present printer head, in which the vertical axis shows the printing time for each dot in micro-second, and the horizontal axis shows the temperature of the external wall of the printer head. Since the printing time for each dot is proportional to the magnetic flux applied to armatures, it is enough to measure the printing time for evaluating the magnetic flux applied to armatures. In FIG. 5, the shaded area shows that an armature can not be attracted to a column core because of the lack of magnetic flux.

In FIG. 5, the curve (a) shows the characteristics that no adjusting yoke is provided, and it is noted that the printing speed is increased in this case as the temperature increases. That is to say, the effective magnetic flux is decreased as the temperature is increased. On the other hand, the curve (b) of FIG. 5 shows the characteristics when the adjusting yoke 12 is provided, and it should be appreciated that the printing time (and the magnetic flux) is almost constant irrespective of the change of the change even from 25° C. to 125° C.

Figure 6:
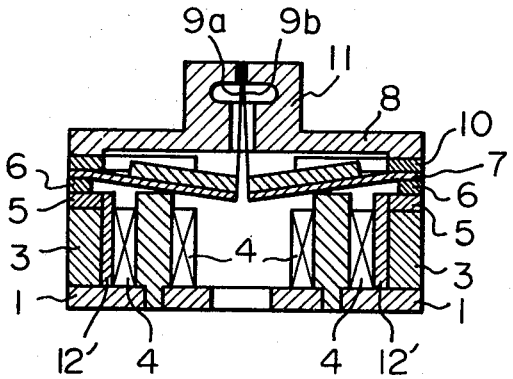
FIG. 6 shows the cross sectional view of another embodiment of the printer head according to the present invention.

FIG. 6 shows the structure of the other embodiment of the present printer head, in which the adjusting yoke 12' which is also C-ring shaped, is inscribed on the inner wall of the permanent magnet 3, while the adjusting yoke 12 of FIG. 3A is circumscribed on the outer wall of the permanent magnet 3. The structure of FIG. 6 has the advantage that the temperature of the coil 4 and/or the column core 2 is sensed quickly by the adjusting yoke 12', since the adjusting yoke 12' is positioned close to those coils and cores. Thus, a more accurate temperature compensation is performed, with the structure of FIG. 3A having the advantage that the adjusting and the mounting of the adjusting yoke can be conveniently performed, as that the yoke is positioned on the outer wall of the permanent magnet.

According to the preferred embodiment of the present printer head, the number of print needles is seven, and thus, the number of projections of the spring 7 and the electromagnets is also seven, the diameter of a print needle 9 is 0.36 mm, and that needle is made of a hard steel including tungsten and cobalt. The permanent magnet 3 has 35 mm of the outer diameter, 22 mm of the inner diameter, and 8 mm of the height, and that magnet is made of ferrite material, which is cheap in price. The column core 2 has 3.5 mm of diameter and is made of silicon steel. The coil 4 would on the column core 2 is an enameled wire of 0.1 mm, and has 490 turns. The electric current applied to that coil is 1 ampere. The disk spring 7 is made of carbon steel for a spring material. The length of a stroke of a print needle is 0.16 mm at the top of a needle, and is 0.4 mm at the portion fixed to an armature. And, in that configuration, the adjusting yoke 12 has 0.8 mm of thickness in case of MS-2 material, and the height of 14 mm.

The adjusting yoke can compensate not only the change of the temperature, but also the weakening of a spring 7. That is to say, when the spring 7 is weakened by the long use of the printer head, the spring force is lessened. When the spring 7 is weak, either the permanent magnet 3 must be weakened also, or the current in the coil 4 must be increased in order to ensure the specified printing speed. In that case, the adjusting yoke can adjust the magnetic flux according to the weakening of the spring 7 and the current in the coil 4.

As described in detail, the present printer head has two magnetic paths. The first path is utilized for operating the printer head, and the second path is utilized to maintain the magnetic flux in the first path constant irrespective of the change of the temperature. In the second magnetic path, the particular adjusting material which has the magnetic characteristics that the magnetic reluctance increases as the temperature increases. Therefore, the present printer head can operate with excellent printing quality and excellent printing speed even in a high temperature condition.

From the foregoing it will now be apparent that a new and improved printer head has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. In a printer head for a mosaic printing comprising of a first circular yoke plate; a cylindrical permanent magnet magnetized in an axial direction positioned on said first yoke plate; the permanent magnet having the characteristics that the flux generated by the permanent magnet decreases as the temperature increases; a ring shaped second yoke plate positioned on said permanent magnet; a plurality of electromagnets each having a column core and a coil wound on the column core, the electromagnets being positioned in a circle on said first yoke plate with predetermined angle intervals therebetween; an armature-print-needle assembly including a disk shaped circular resilient spring having a plurality of inwardly extending projections, a plurality of armatures each fixed on a corresponding projection of said spring and a plurality of print needles each fixed to a corresponding armature so that the print needle extends perpendicular to the plane of the spring; a guide frame covering said armature-print-needle assembly said guide frame having a thin linear slit for passing therethrough the tops of said print needles; wherein a first substantially closed magnetic path is formed from said permanent magnet through said second yoke plate, said armatures, said electromagnets and said first yoke plate to said permanent magnet such that an armature together with the corresponding print needle are attracted to the corresponding electromagnet by the magnetic flux circulating in said first magnetic path and said armature and the corresponding print needle are released by the force of the spring upon application of an electric current to the coil of the corresponding electromagnet to print a dot; the improvment wherein a cylindrical adjusting yoke means is coupled to said first yoke plate, said permanent magnet and said second yoke plate for forming a second closed magnetic path from said permanent magnet through the second yoke plate, the adjusting yoke means and the first yoke plate to the permanent magnet, said adjusting yoke means having a magnetic characteristic wherein the magnetic reluctance of said adjusting yoke means increases as the temperature of said adjusting yoke means increases.

2. A printer head according to claim 1, wherein said adjusting yoke means surrounds the outer edge of said first yoke plate, said permanent magnet and said second yoke plate.

3. A printer head according to claim 1, wherein said adjusting yoke means is positioned on the first yoke plate and within the inner wall of said permanent magnet and said second yoke plate.

4. A printer head according to claim 1, wherein the the top of said adjusting yoke means is at approximately the same level as that of the column cores of said electromagnets.

5. A printer head according to claim 1, wherein said permanent magnet is made of ferrite material.

6. A printer head according to claim 1, wherein said adjusting yoke means is made of an Fe-Ni-Cr alloy.

* * * * *

UNITED STATES PATENT AND TRADEMARK OFFICE

CERTIFICATE OF CORRECTION

PATENT NO. : 4,377,348

DATED : March 22, 1983

INVENTOR(S) : MINORU ISOBE ET AL

It is certified that error appears in the above-identified patent and that said Letters Patent is hereby corrected as shown below:

On the cover page, Item 73, after "Oki Electric Industry Co., Ltd." insert --- Nippon Telegraph & Telephone Public Corporation, Tokyo, Japan ---.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*